US010154710B2

(12) United States Patent
Yep

(10) Patent No.: US 10,154,710 B2
(45) Date of Patent: Dec. 18, 2018

(54) DUAL HALO RING WITH REMOVABLE INNER RING

(71) Applicant: Mau Koung Yep, Road Town (VG)

(72) Inventor: Mau Koung Yep, Road Town (VG)

( * ) Notice: Subject to any disclaimer, the term of this patent is extended or adjusted under 35 U.S.C. 154(b) by 172 days.

(21) Appl. No.: 15/431,865

(22) Filed: Feb. 14, 2017

(65) Prior Publication Data

US 2018/0228255 A1 Aug. 16, 2018

(51) Int. Cl.
*A44C 9/00* (2006.01)
*A44C 17/00* (2006.01)

(52) U.S. Cl.
CPC ..... *A44C 9/0023* (2013.01); *A44C 9/003* (2013.01); *A44C 17/00* (2013.01)

(58) Field of Classification Search
CPC ..... A44C 9/0023; A44C 9/003; A44C 9/0015; A44C 9/0007
USPC ..... 63/15.1, 15.2, 15.4; D11/26, 34, 37
See application file for complete search history.

(56) References Cited

U.S. PATENT DOCUMENTS 424,211 A * 3/1890 Kaas ..... A44C 9/0023 63/15.3
1,245,201 A * 11/1917 DePollier ..... A44C 9/0023 63/15.4
5,253,490 A * 10/1993 Doganay ..... A44C 9/0023 63/15
D680,023 S * 4/2013 Ho ..... D11/34

FOREIGN PATENT DOCUMENTS

FR 2352510 A1 * 12/1977 ..... A44C 9/0023

* cited by examiner

*Primary Examiner* — Jack W Lavinder
(74) *Attorney, Agent, or Firm* — Michael J. Feigin, Esq.; Feigin & Fridman

(57) ABSTRACT

A halo effect ring has an inner halo fixedly connected to an inner ring, and an outer halo fixedly connected to an outer ring. Both rings can have gems in settings and other ornamentation, and when combined, the halos are in concentric circles, when viewed from above, with at least part of the inner ring or it's setting or other attached parts rising through the outer halo. Another outer ring is hingedly connected to the first outer ring, and removably connected to the outer halo such that the halo can sit flush with a top side of the outer rings.

17 Claims, 17 Drawing Sheets

DUAL HALO RING WITH REMOVABLE INNER RING

FIELD OF THE DISCLOSED TECHNOLOGY

The disclosed technology relates generally to rings, and more specifically, to combination rings.

BACKGROUND OF THE DISCLOSED TECHNOLOGY

Combination wedding and engagement rings are known in the art. They generally work by having an outer ring with an opening on top through which an inner ring is inserted. The inner ring typically then remains unsecured between the outer rings. This configuration works, but limits the configuration of each ring because the inner ring must fit entirely between a space between the two outer rings. Should one wish to use a wider inner ring, or wish to have the outer engagement ring have something other than a gaping hole between the two sides, he or she is out of luck.

What is needed in the industry is a way to provide a combination wedding and engagement ring where each ring can have a full setting and the top of the engagement ring can be connected so that it does not look like two separate rings and is aesthetically more pleasing even when worn without the wedding ring.

SUMMARY OF THE DISCLOSED TECHNOLOGY

A halo effect ring has a halo on the top side thereof. For purposes of this disclosure, a top side is a side with the halo which is attached to various rings, the rings being adapted or configured to be placed around a finger or other part of the body. It should be understood that the body or parts of the body are not being claimed, but is used for descriptive purposes to describe parts of the ring or how the ring is placed on the body. A bottom side is a side with a hinge and is generally opposite the top side. "Generally" for purposes of this disclosure, is defined as what an ordinary observer would consider to be so. Thus "generally" on opposite sides refers to how a person would describe the halo and the hinge or far side of the rings as being on opposite sides. "Substantially" is defined as "at least 95%" of what the term describes or how two items are compared to each other.

A "halo" is defined as a jeweled ring with an open center in which there is a portal or other items placed there-in or there-through. The halo effect ring has halos which are perpendicular to the most elongated length, or direction of portions which pass-therethrough, of one or a plurality of rings. The rings, as used in this disclosure, are different from halos in that they are designed for, configured for, adapted for, or designated for a finger or other part of the body to pass through whereas the halos are for placement of ornamental features, such as gemstones to pass through and/or be fixed connected there-to.

A halo, in embodiments of the disclosed technology, is formed from both an inner concentric circle and an outer concentric circle. These concentric circles are, in turn, attached to respective rings. A first outer ring and a second outer ring each have substantially identical portals to each other and are connected to the outer concentric circle in two ways, in embodiments of the disclosed technology. In one instance, the outer concentric circle (or halo) is fixedly connected, and in some embodiments, substantially perpendicularly or acutely fixedly connected to the first outer ring.

In another instance, the outer concentric circle is removably connected to the second outer ring. A hinge rotatably connects the first outer ring and the second outer ring to each other, generally at an opposite side (bottom side) of each outer ring from where the respective outer rings connect to the outer concentric circle. Meanwhile, the inner concentric circle is fixedly connected to the inner ring and has a portal substantially aligned with said identical portals of the first outer ring and the second outer ring when the rings are aligned with one another.

For purposes of this disclosure, "fixedly connected" is defined as "a connection between two different parts which is designed to stay together in a particular orientation with a particular connection for a period of greater than one year and which generally or substantially always requires breaking physical pieces not meant to be broken apart in order to disconnect the two different parts from one another." Conversely, "removably connected" is defined as "able to connect and reconnect repeatedly, at least multiple times per day, without causing substantial harm or disfiguration of parts which are connected as such."

In some embodiments, the inner ring is frictionally held against the hinge. The inner concentric circle (or halo) and/or the inner ring can additionally be frictionally held against the outer concentric circle. "Frictionally held" is defined as "abutted against another object such that movement further towards the other object is prevented" and generally functions without adhesive or mechanical connections of any kind, other than as described in the definition thereof. The term "and/or", as used in this disclosure, includes one of, or both terms joined by the conjunction.

The inner concentric circle is further from the hinge than the outer concentric circle, in some embodiments, because the inner concentric circle rises through and past the outer concentric circle in these embodiments. The inner ring can be perpendicular to the inner concentric circle, and further, can be aligned with a diameter of the inner concentric circle. That is, if one took a diameter of the inner concentric circle and extended the line segment which is the diameter upwards and downwards, creating a two-dimensional plane, the inner ring would lie on this plane. The inner ring is thus centered with respect to the inner halo in such embodiments. As the inner halo is centered within the outer halo, viathe transitive property, one can also ascertain that the inner ring can be perpendicular to a diameter of the outer circle as well as be centered with respect to a plane which is perpendicular to the outer halo.

The outer concentric circle has a spherical projection, in some embodiments, which is aligned perpendicularly to the outer concentric circle and on a bottom side thereof. The bottom side is opposite a top side; the top side being one that pointed away from the portals if one were to move towards the top. The second outer ring can have a two sided clasp gripping the spherical projection. This two sided clasp is repeatedly removable and connectable to the spherical projection. The first outer ring and the second outer ring are rotatable with respect to one another by way of the hinge and are mirrored on either side of the inner ring when the two sided clasp is gripping the spherical projection. The inner concentric circle passes through the outer concentric circle before the second outer ring is attached to the outer concentric circle, in embodiments of the disclosed technology.

The inner ring is wider than a space enclosed by the outer concentric circle requiring that the inner concentric circle, which is fixedly attached to the inner ring, pass through a lower side of the outer ring in order for the inner concentric circle to be concentric to the outer concentric circle when the rings are in the same orientation. The inner ring rises through the inner concentric circle and the inner concentric circle is filled therewith, in embodiments of the disclosed technology. The outer concentric circle has a portal sized to fit around the inner concentric circle, in embodiments of the disclosed technology. "Size to fit" is defined as the two items having identical or substantially identically shaped sides, or portions of sides which are abutted against one another such that a space no wider than the narrowest portion of each item being sized to fit together is created there-between.

The inner and outer halo can each have a circle of identically sized gems. The first outer ring and the second outer ring have a rotatable range of motion with respect to one another of up to 90 degrees, in some embodiments. An outer diameter of the inner ring is substantially equal to the shortest distance between the hinge and the outer concentric circle in embodiments of the disclosed technology.

Three steps are formed at a top side of the halo effect ring in some embodiments. A step is defined as a generally or substantially flat side which is parallel to another generally or substantially flat side, with the two flat sides having different elevations. The steps can be connected by different vertical pieces. A first stepnis formed from the outer concentric circle which is both fixedly and removably attached to the outer ring, a second step is formed from the inner concentric circle which is fixedly attached to the inner ring, and a third step with gems is centered within a plane which extends perpendicularly to an inner region of the inner concentric circle.

A method of donning such a halo effect ring is carried out by separating the second outer ring from the outer concentric circle. This involves, in embodiments, rotating the hinge. Then one inserts the inner concentric circle into the outer concentric circle and rests the inner ring on the hinge. Then one attaches the second outer ring to the outer concentric circle such that the portal of the first outer ring, the second outer ring, and the inner ring are in alignment.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

A halo effect ring has an inner halo fixedly connected to an inner ring, and an outer halo fixedly connected to an outer ring. Both rings can have gems in settings and other ornamentation, and when combined, the halos are in concentric circles, when viewed from above, with at least part of the inner ring or its setting or other attached parts rising through the outer halo. Another outer ring is hingedly connected to the first outer ring, and removably connected to the outer halo such that the halo can sit flush with a top side of the outer rings.

Embodiments of the disclosed technology are described below, with reference to the figures provided.

Figure 1:
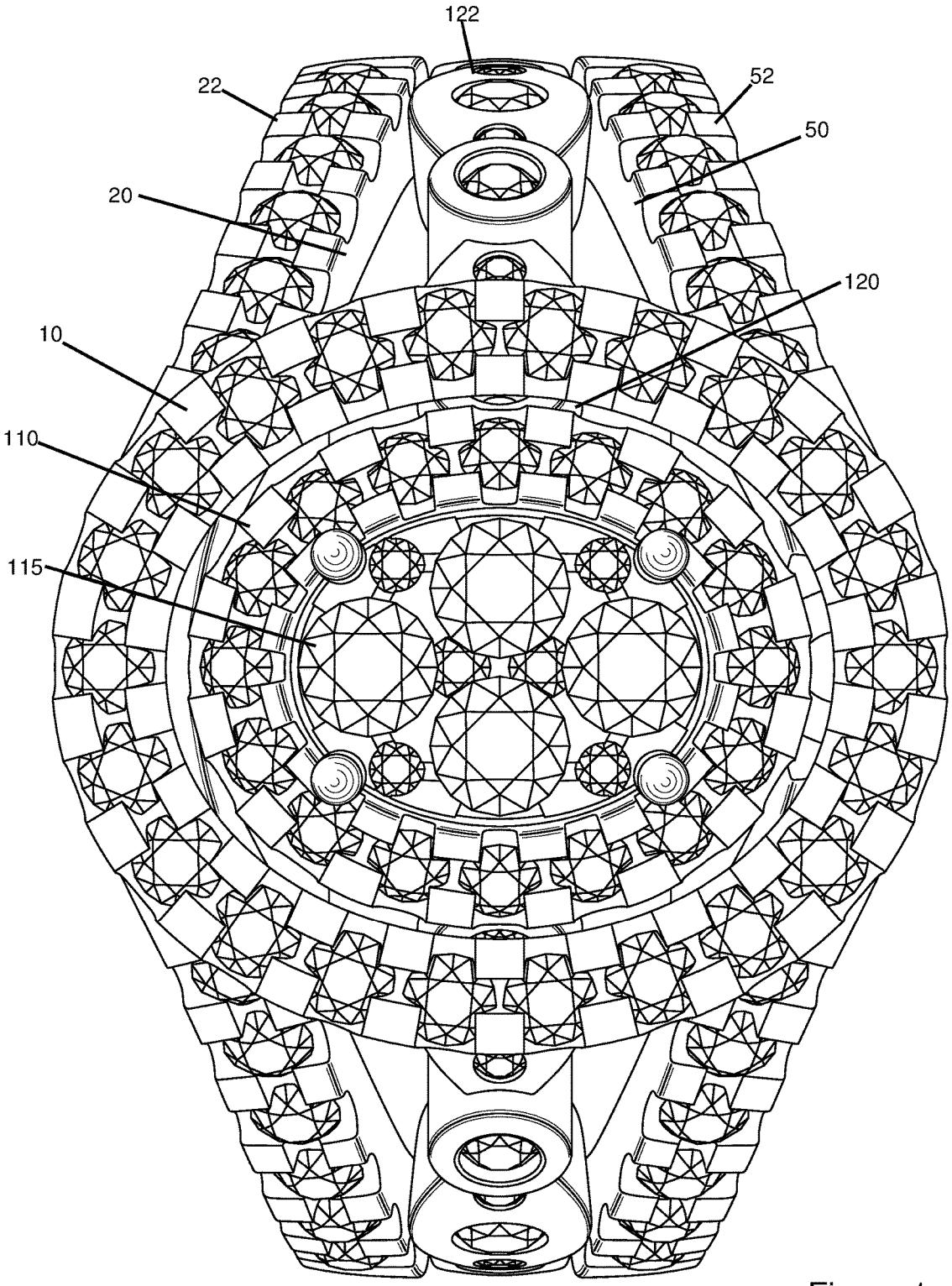
FIG. 1 shows a plan view from atop the combined outer and inner rings forming concentric hallows looking downwards, in an embodiment of the disclosed technology.
Figure 2:
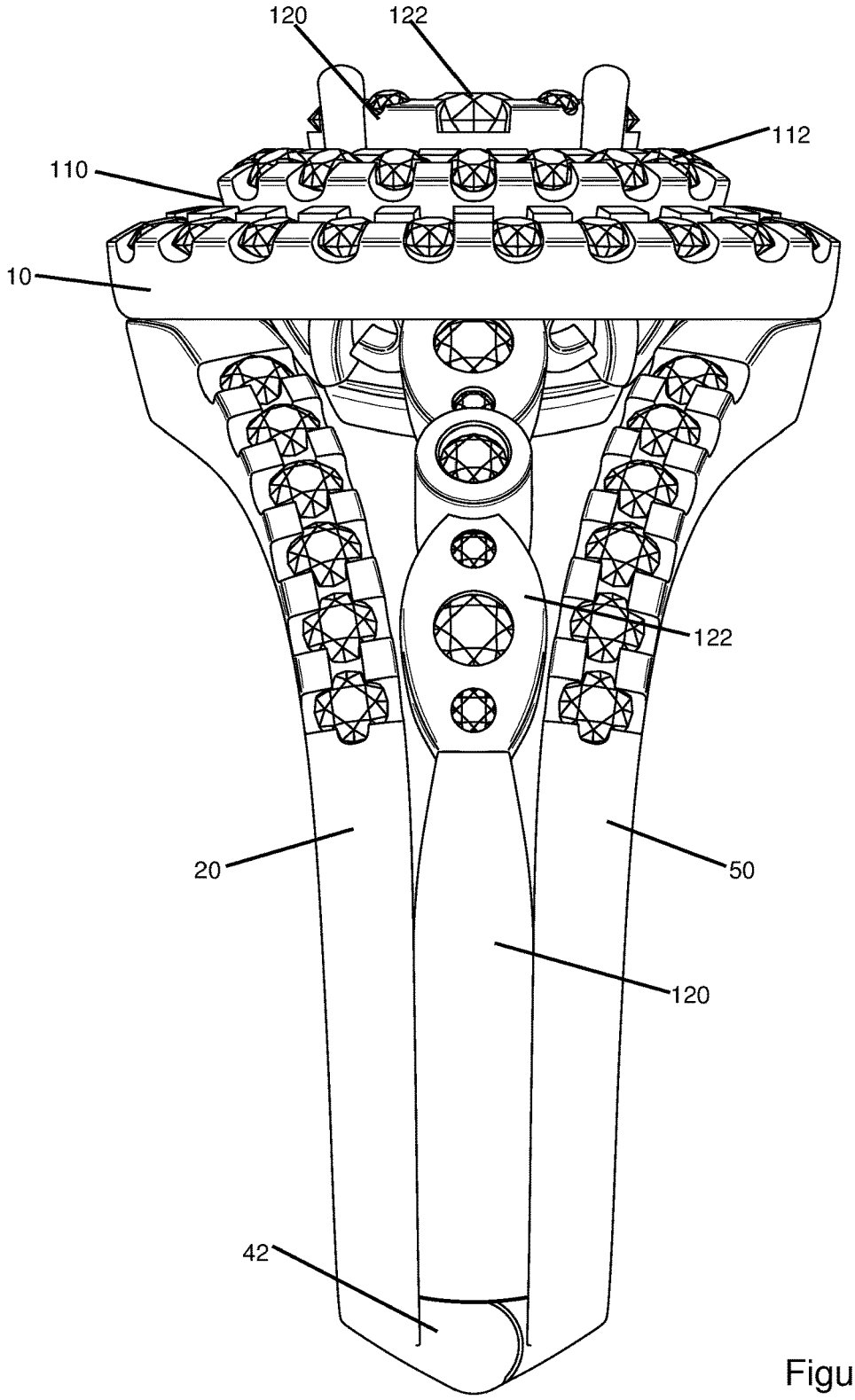
FIG. 2 shows a side elevation view of the rings of FIG. 1.
Figure 3:
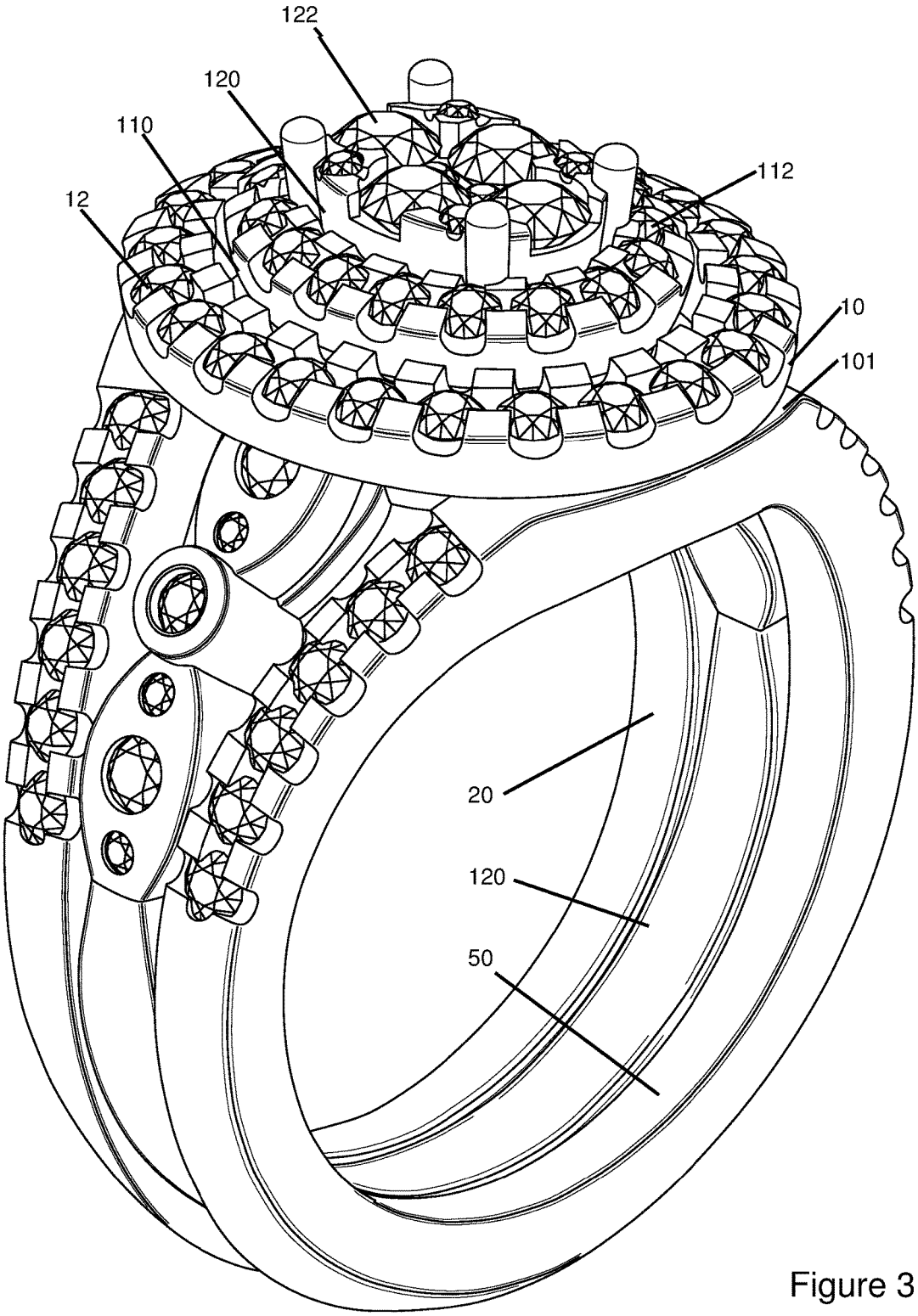
FIG. 3 shows a top and side perspective view of the rings of FIG. 1.
Figure 4:
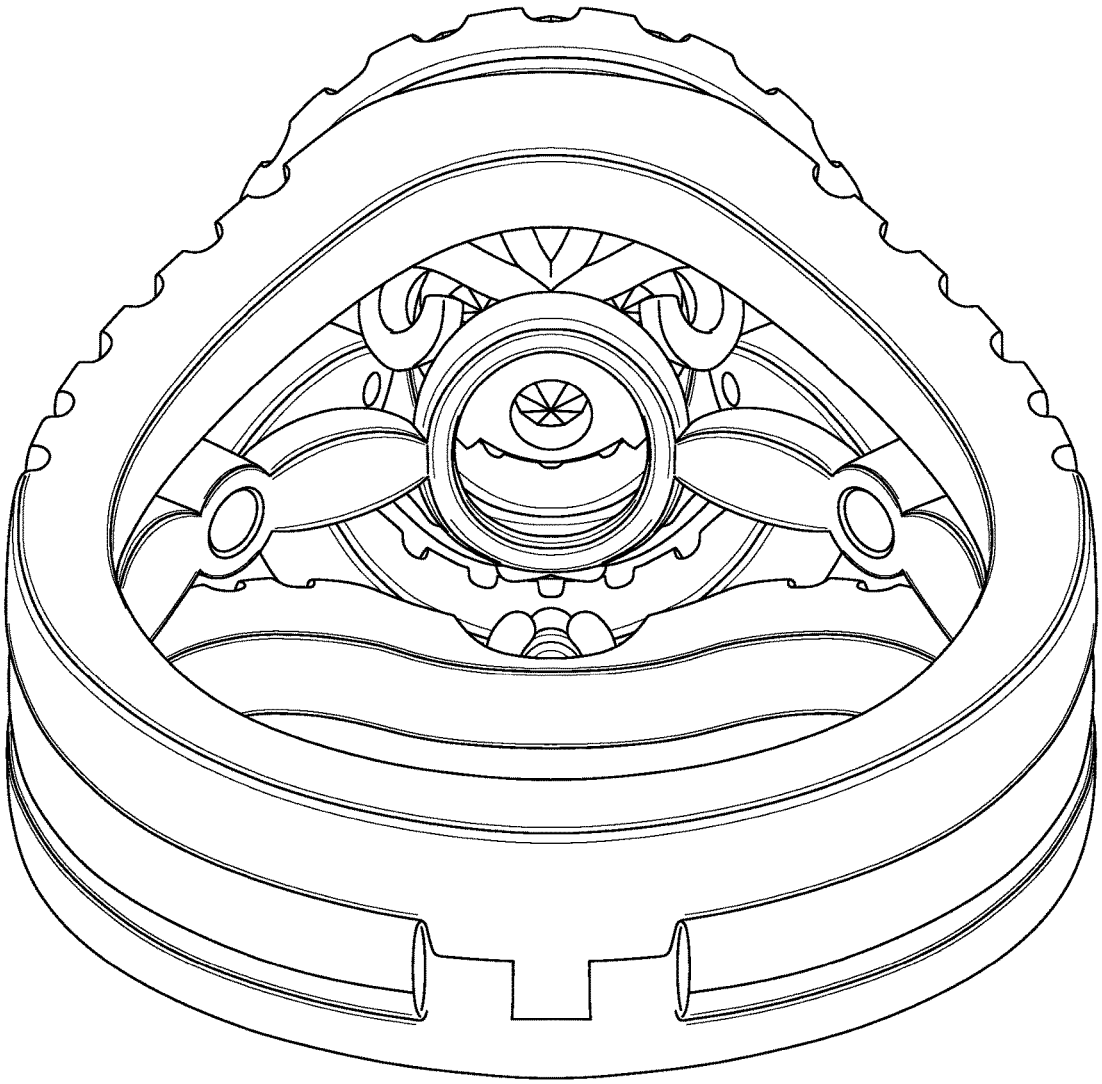
FIG. 4 shows a bottom and side perspective view of the rings of FIG. 1.

Discussing first FIGS. 1 through 4, FIG. 1 shows a plan view from atop the combined outer and inner rings forming concentric hallows looking downwards, in an embodiment of the disclosed technology. FIG. 2 shows a side elevation view of the rings of FIG. 1. FIG. 3 shows a top and side perspective view of the rings of FIG. 1. FIG. 4 shows a bottom and side perspective view of the rings of FIG. 1. Here, one sees an inner ring 120 having a halo 110, a first outer ring 20 fixedly connected to a halo 10, and a second outer ring 50 which is removably connected to the halo 10. The first and second ring are connected by a hinge 42. The halo 110 of the inner ring is concentric with the halo 110 of the outer rings in embodiments of the disclosed technology. An inner ring of gems 122 in an inner portion 120, inside the inner halo 110, can fill a space defined by the inner halo/inner concentric circle 110.

Referring to FIG. 3 specifically, each outer ring 20 and 50 has an upper side 101 which is flat in embodiments of the disclosed technology. This flat side abuts and connects to a lower side of the outer ring 10. The inner ring 120 then passes through a plane extending from the upper side 101. It can further be seen that the halo 110 of the inner ring is wider than the widest width of the outer rings 20 and 50 in the configuration shown in FIGS. 1-3. However, the inner ring 120 is removable. The halo 10 of the outer rings prevents the inner ring 120 from being inserted between the outer rings 20 and 50. This is, in the prior art, how one typically places an outer ring between inner rings in a set. This prevents a halo from being used. Here, however, the halo/inner concentric circle 110 of the inner ring is fixedly attached to the inner ring 120. It is also, in embodiments, generally extending in a direction perpendicular to the inner ring and further, centered over the inner ring such that the ring lies along a diameter of the inner halo 110 and outer halo 10. Likewise, the outer halo/outer concentric circle 120 is also fixedly attached to the outer ring 20 in a perpendicular direction there-to. As such, the manner in which the inner ring 120 is inserted is by rotating a second outer ring 50 away from the first outer ring 20. This is shown in the following figures.

Figure 5:
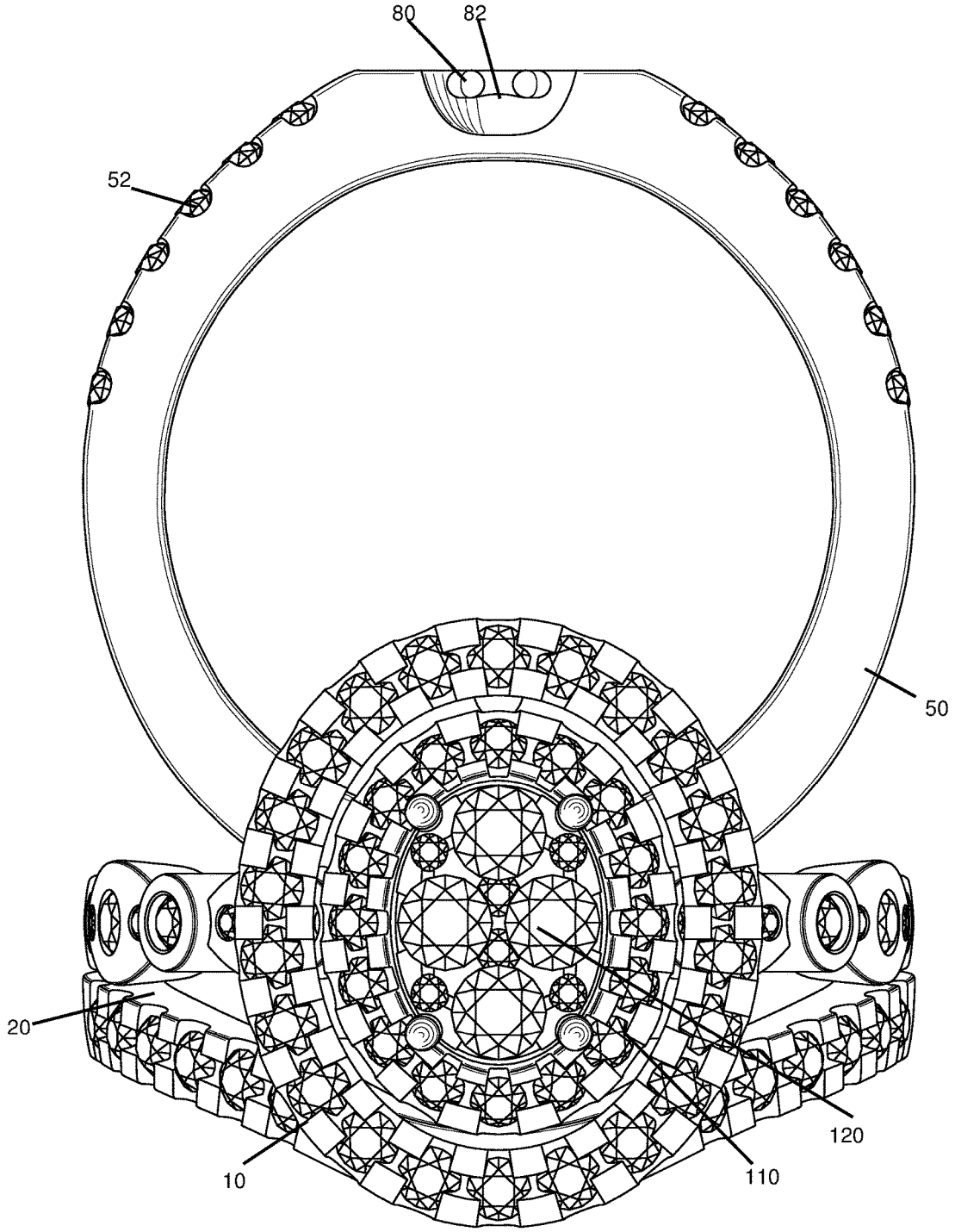
FIG. 5 shows another top view of the rings of FIG. 1, with an outer ring opened 90 degrees relative to another outer ring.
Figure 6:
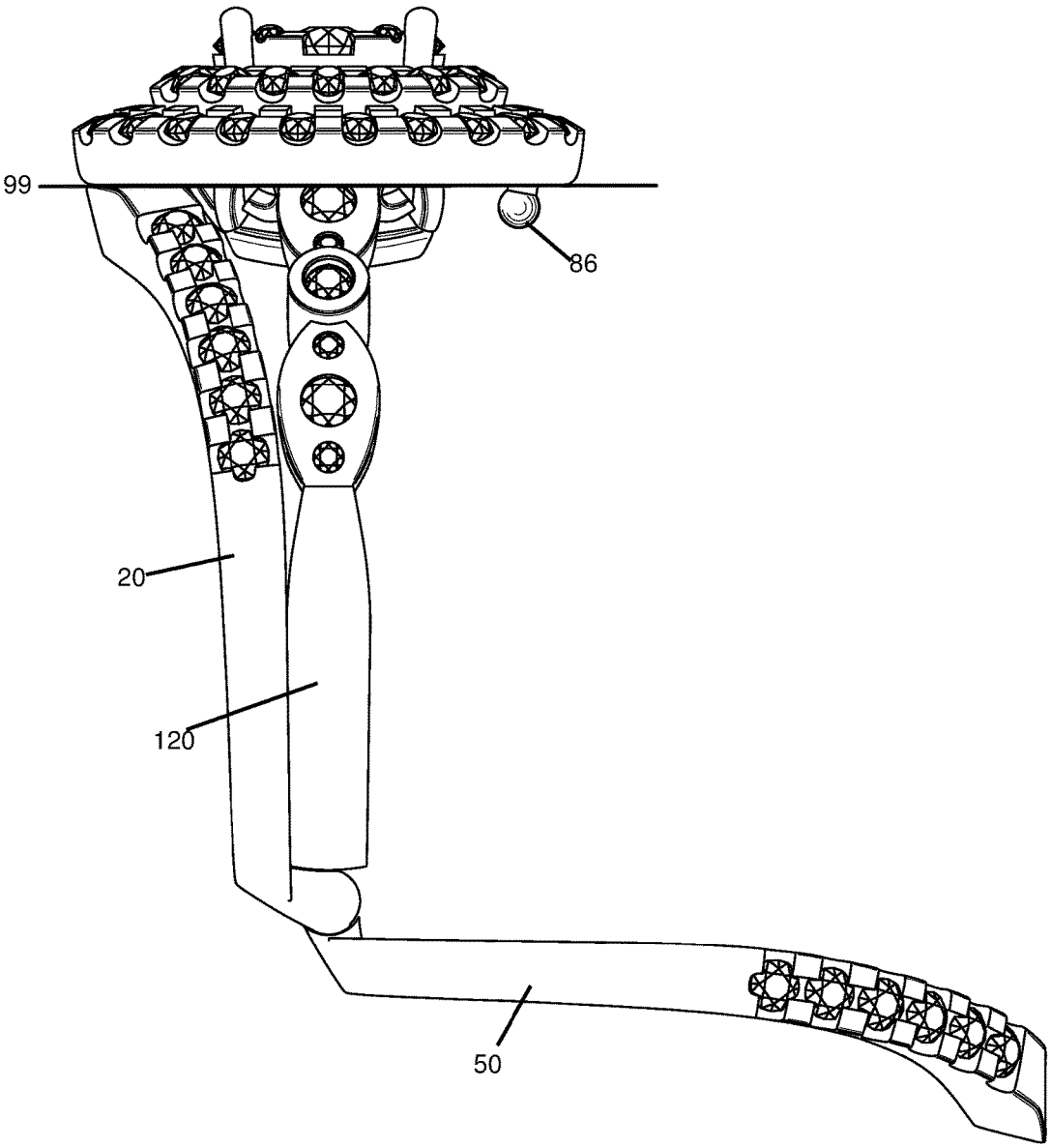
FIG. 6 shows a side elevation view of the rings of FIG. 1, with the outer ring opened 90 degrees.
Figure 7:
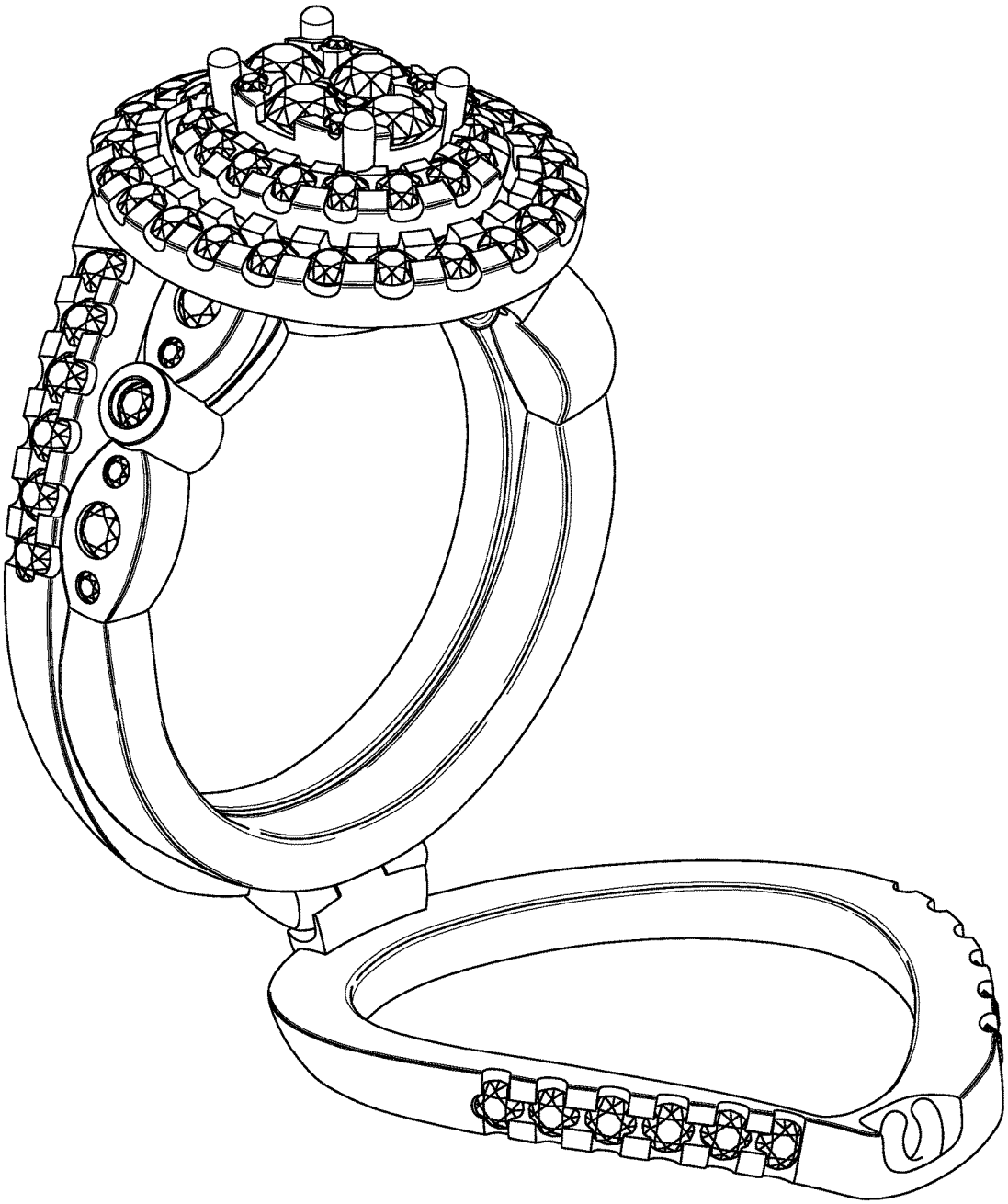
FIG. 7 shows a top and side perspective view of the rings of FIG. 1, with a side of the outer ring opened 90 degrees.
Figure 8:
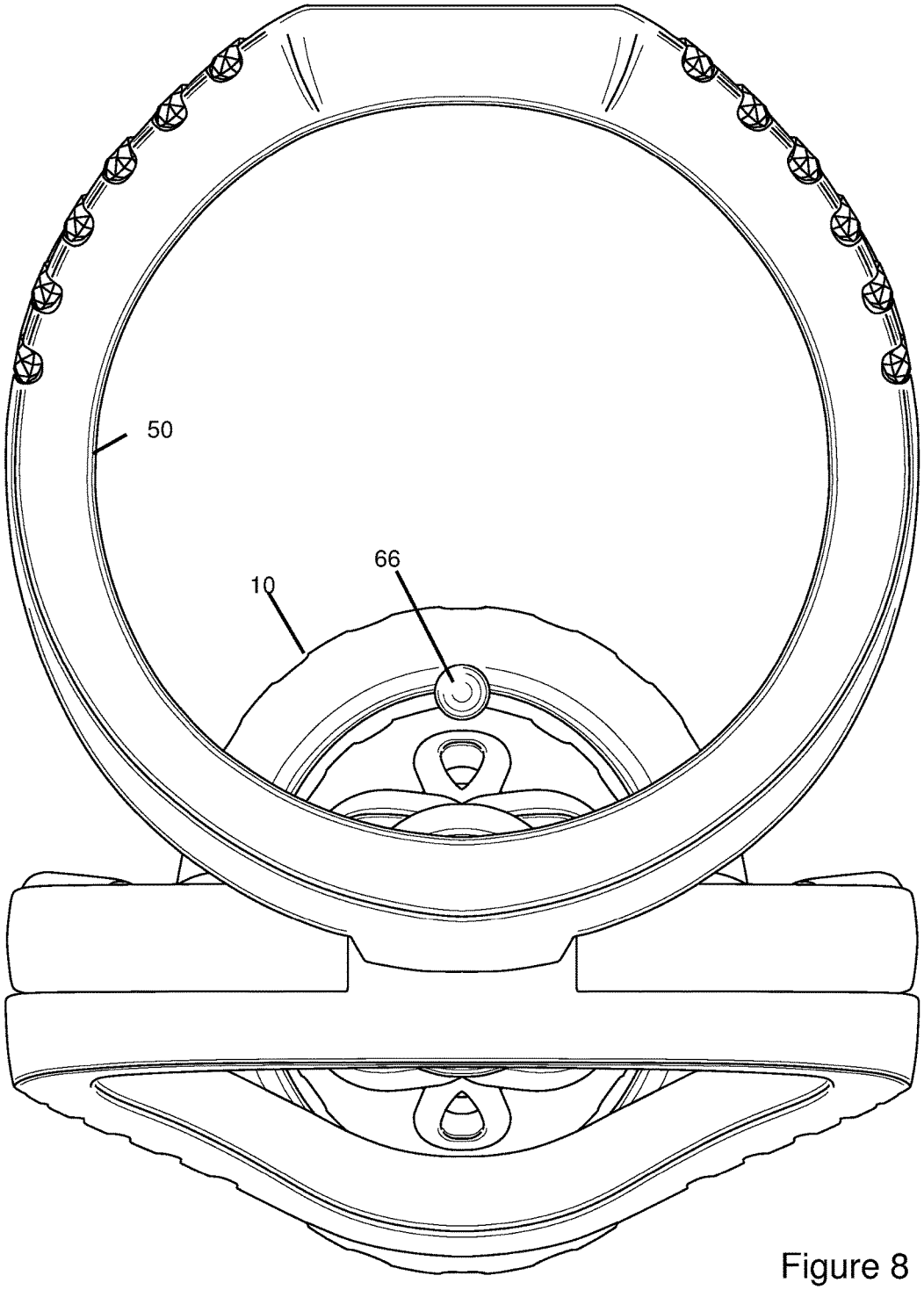
FIG. 8 shows a bottom plan view of the rings of FIG. 1, with a side of the outer ring opened 90 degrees.
Figure 9:
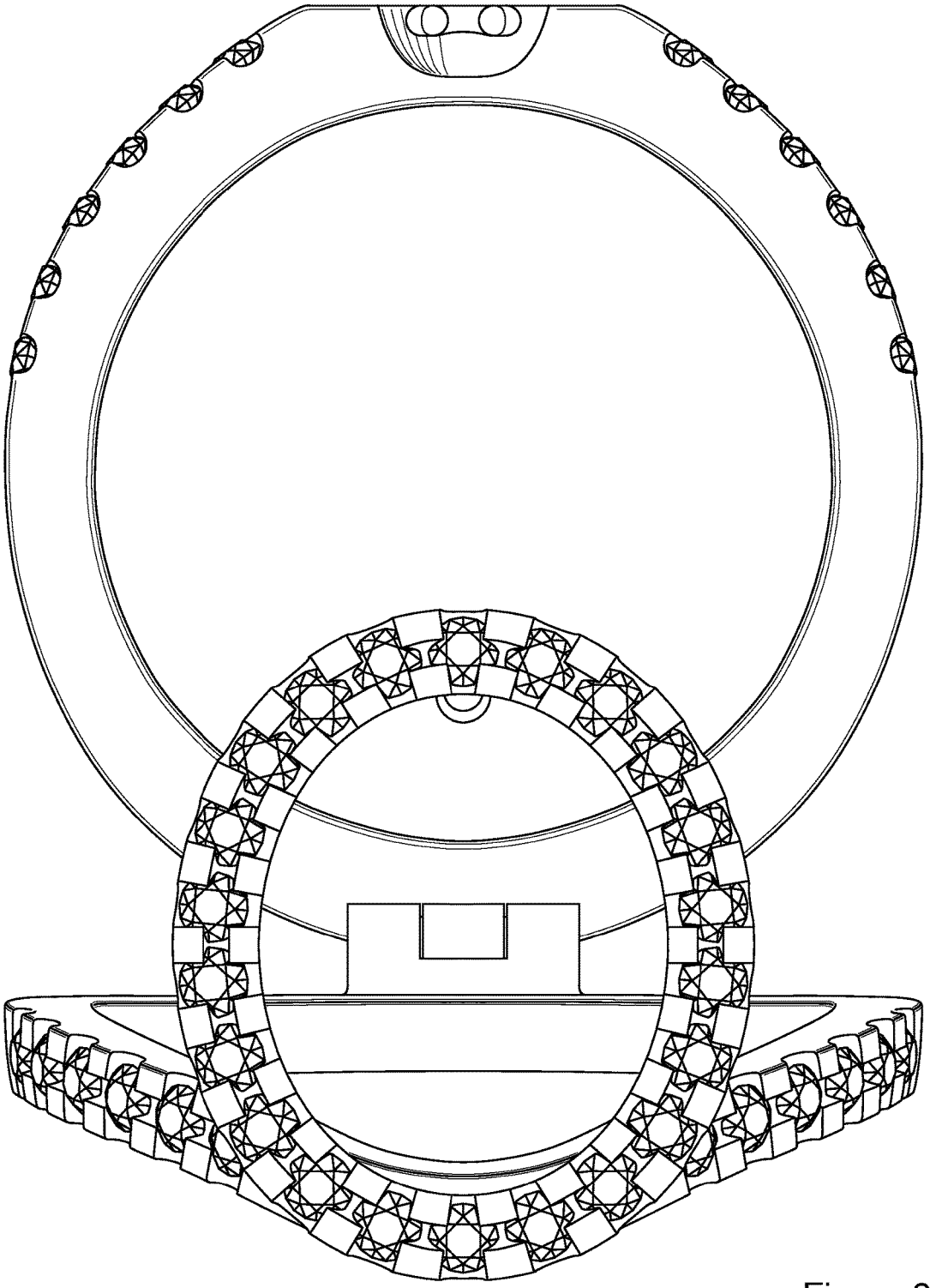
FIG. 9 shows a top plan view of the outer ring, with a side opened 90 degrees, of an embodiment of the disclosed technology.
Figure 10:
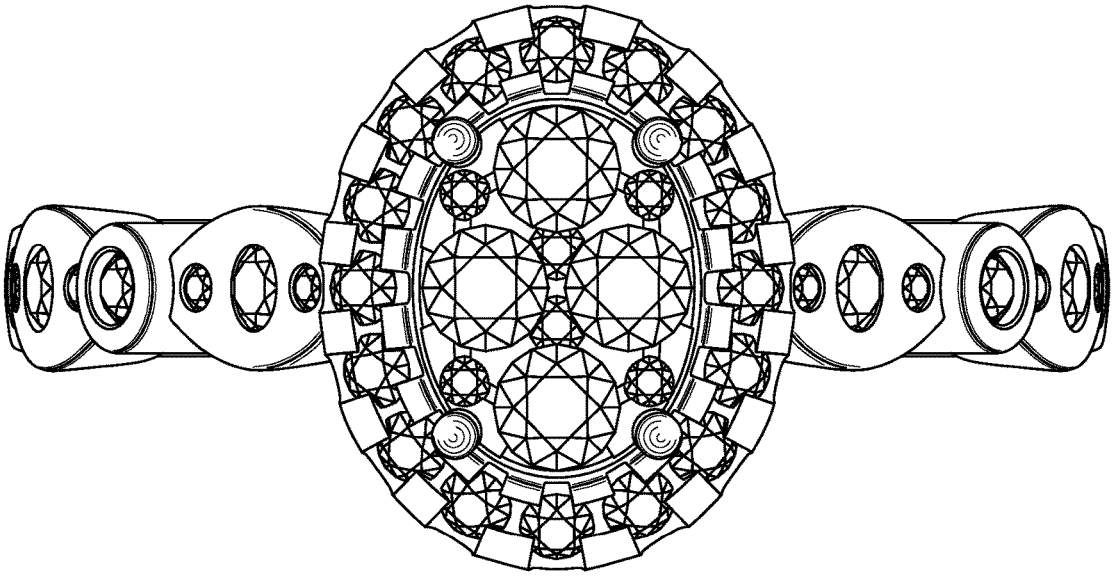
FIG. 10 shows a top plan view of the inner ring, in an embodiment of the disclosed technology.

FIG. 5 shows another top view of the rings of FIG. 1, with an outer ring opened 90 degrees relative to another outer ring. FIG. 6 shows a side elevation view of the rings of FIG. 1, with the outer ring opened 90 degrees. FIG. 7 shows a top and side perspective view of the rings of FIG. 1, with a side of the outer ring opened 90 degrees. FIG. 8 shows a bottom plan view of the rings of FIG. 1, with a side of the outer ring opened 90 degrees. In these views, one can see that the second outer ring 50 is rotated 90 degrees with respect to the first outer ring. The bottom side of the outer halo/concentric circle 10 is aligned with line segment 99 as is the top side of the outer ring 20. The inner ring 120 passes through the line segment 99, up into a space defined by the outer halo 110, such that the inner halo 110, though having, in some embodiments, a same height from top to bottom as the outer halo, is raised above the outer halo.

The underside of the outer halo 10 is fixedly connected to a first ring 20, and fixedly connected to a spherical projection 86 which extends beneath the line 99 and generally or substantially downwards from the outer halo 10. The spherical projection 86 can be spherical, partially spherical, rounded, and/or otherwise act as a fixed-shaped connector. Meanwhile, as shown, for example in FIG. 5, a two-sided clasp 80 is placed into an intended region 82 of the second ring 50, having a line of gemstones (also referred to as a type of ornamentation) 52. The two-sided clasp 80 is deformable (shape changes slightly, or up to 25%, while returning to an original shape before the change) by pressing the spherical projection 86 there-between the two sides. In this manner, the second ring 50 can be removably connected to the underside of the outer halo or concentric circle 10.

Figure 11:
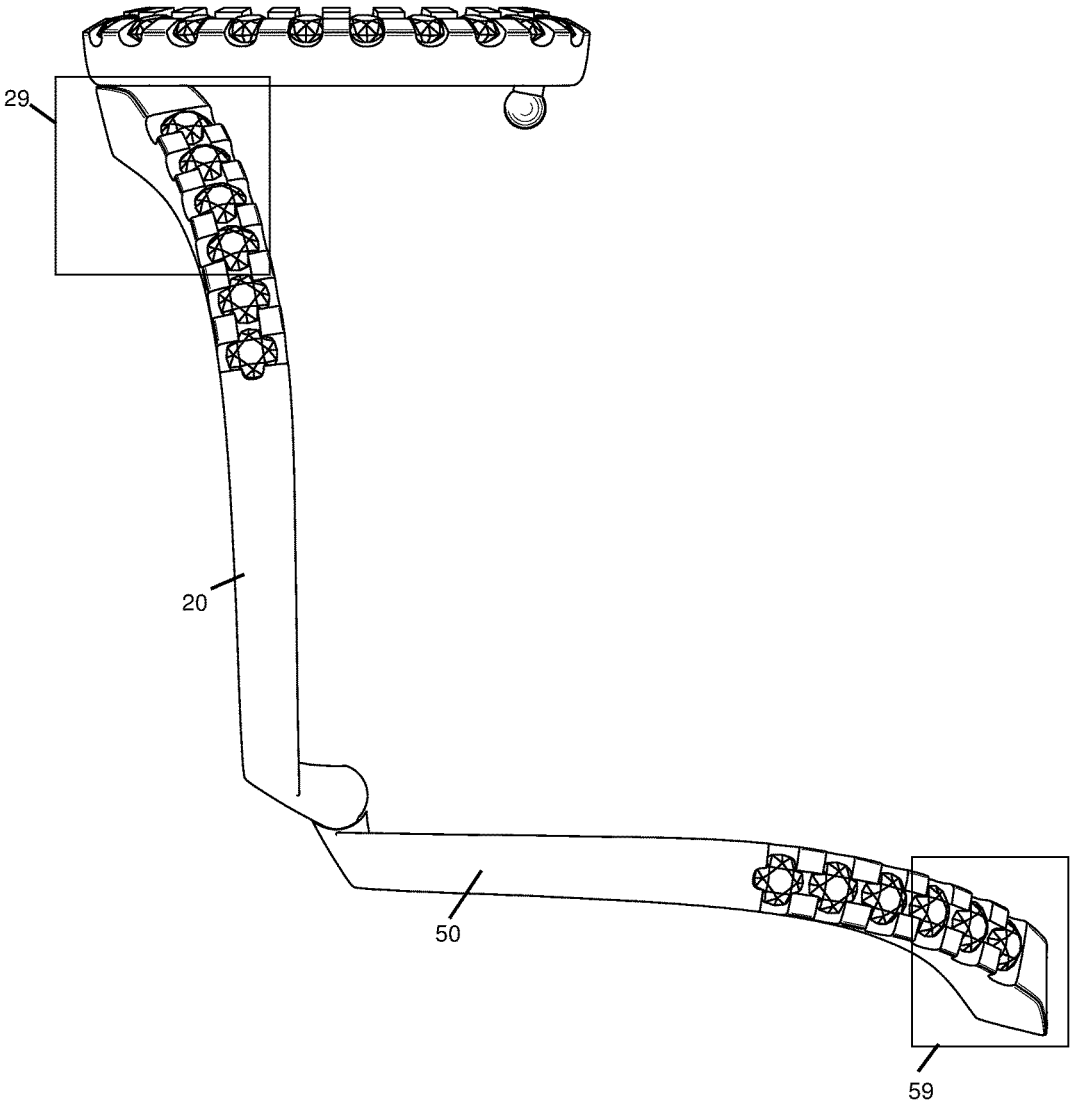
FIG. 11 shows a side elevation view of the outer ring, in an embodiment of the disclosed technology.

Skipping to FIG. 11, FIG. 11 shows a side elevation view of the outer ring, in an embodiment of the disclosed technology. The upper ends of each first and second outer ring 20 and 50 are bent outwards from each other in a mirror image format. This allows for more width of the inner ring and attached parts thereto. The outward extending portions are numbered 29 (for the ring 20) and 59 (for the ring 50) and are defined as a region of each ring which extends from a top side of each ring to a point where the slope increases or infects from a prior constant slope. As shown in FIG. 3, one can see the inner ring 120 is aligned with and generally the same or exactly the same in orientation, width, overall size, inner circumference and outer circumference from the bottom most region until the outward extending portions. At the outward extending portions, the inner ring 120 gets wider than the outer rings in an embodiment of the disclosed technology, generally filling a space between the outer rings 20 and 50 when the rings are put together with one another.

Figure 12:
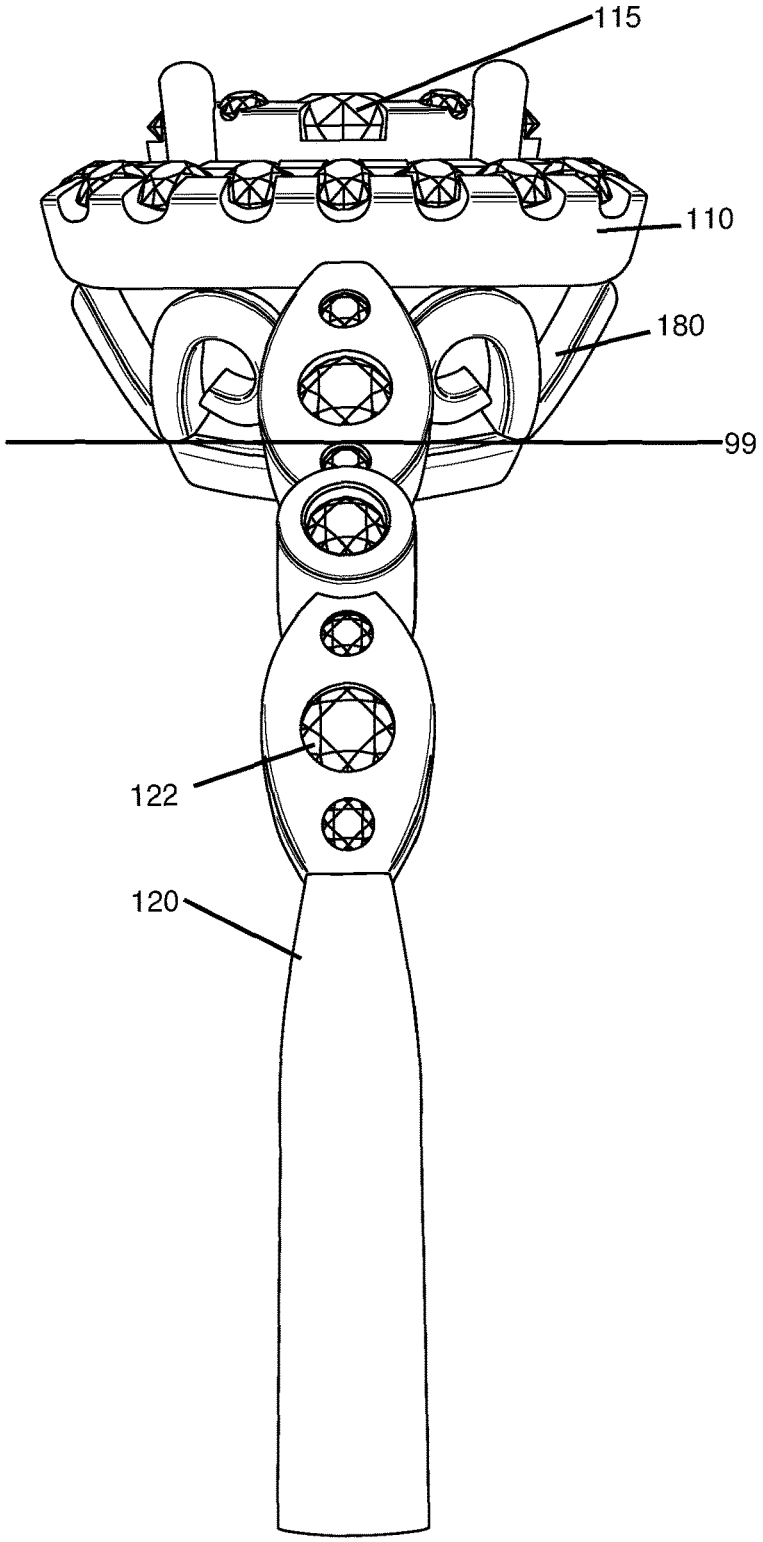
FIG. 12 shows a side elevation view of the inner ring, in an embodiment of the disclosed technology.

FIG. 12 shows a side elevation view of the inner ring, in an embodiment of the disclosed technology. Above horizontal plane 99 is inside or above the outer concentric circle 10 of the outer rings 20 and 50, in one embodiment of the disclosed technology. Note that three dimensional ornamentation 180 (designs which are for aesthetic use, or primarily for aesthetic use rather than functional use) can be provided above the horizontal plane 99 which fits within the outer halo 10. The inner ring 120 can also have ornamentation 122 on the ring portion itself, at an upper region thereof corresponding to the outward extending portions 29 and 59 of the outer rings 20 and 50, respectively. In some embodiments, the ornamentation 122 extends wider than the lower region of the inner ring 120, the lower region fitting snuggly between the outer rings. The upper region, defined as where the ornamentation 122 starts, also fits snuggly between the outer rings, though in the upper regions, the outer rings 20 and 50 are extending outward, in embodiments, at a greater and increasing line slope than at the lower regions.

Figure 13:
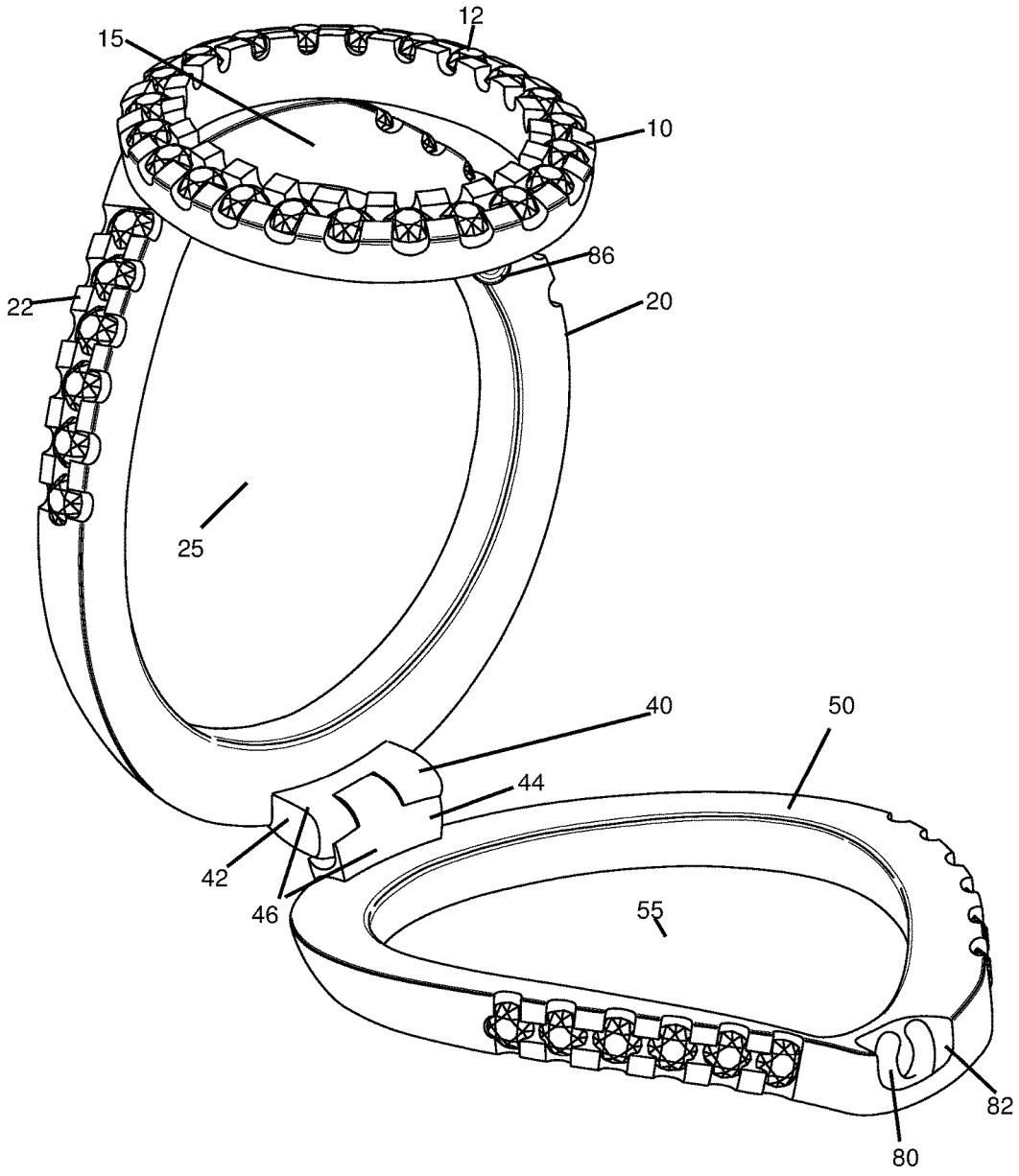
FIG. 13 shows a top and side perspective view of the outer ring, with a side opened 90 degrees, in an embodiment of the disclosed technology.

FIG. 13 shows a top and side perspective view of the outer ring, with a side opened 90 degrees, in an embodiment of the disclosed technology. The portals adapted for placement of one's finger are portal 25 of the first outer ring and portal 55 of the second outer ring. The hinge 40 has two portions of the hinge, in some embodiments, which face upwards and/or into an area between the two outer rings. On this upwards side 46 between the two rings is where the inner ring 120 rests and is frictionally held, as it is between the hinge 40 and, on the opposite side, the outer halo 10. The ring 120 itself thus is frictionally held between the outer halo 10 and hinge 40, both of which are fixedly attached to the first outer ring 20. The hinge 40 has two portions, 42 and 44, each fixedly connected to respective outer rings 20 and 50. In some embodiments, the inner ring 120 fits in a groove of the hinge 40 created in a portion of hinge portion 44 which lies lower than hinge portion 42 when the second outer ring 5 is connected to the spherical protrusion 86.

Figure 14:
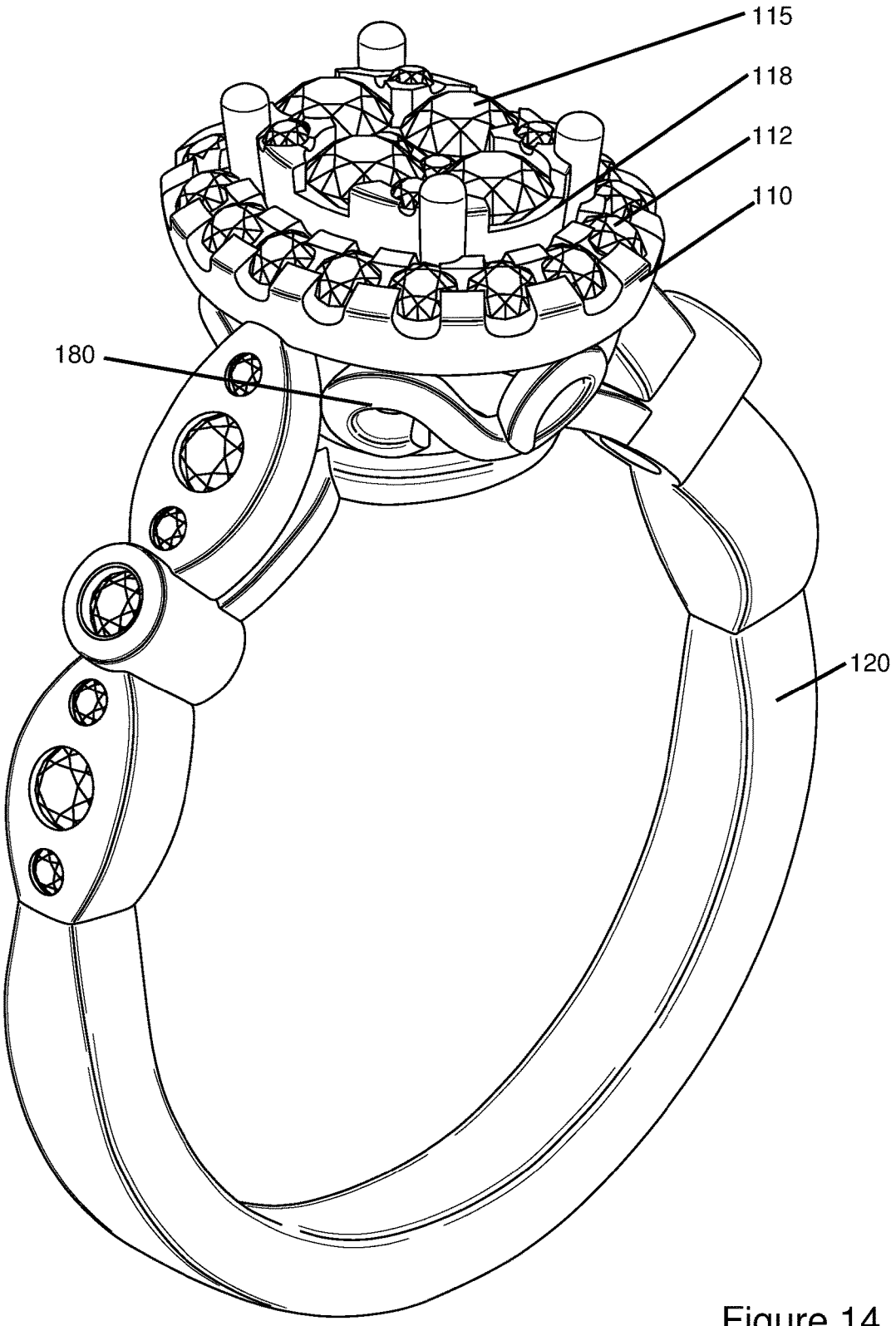
FIG. 14 shows a top and side elevation view of the inner ring, in an embodiment of the disclosed technology.
Figure 15:
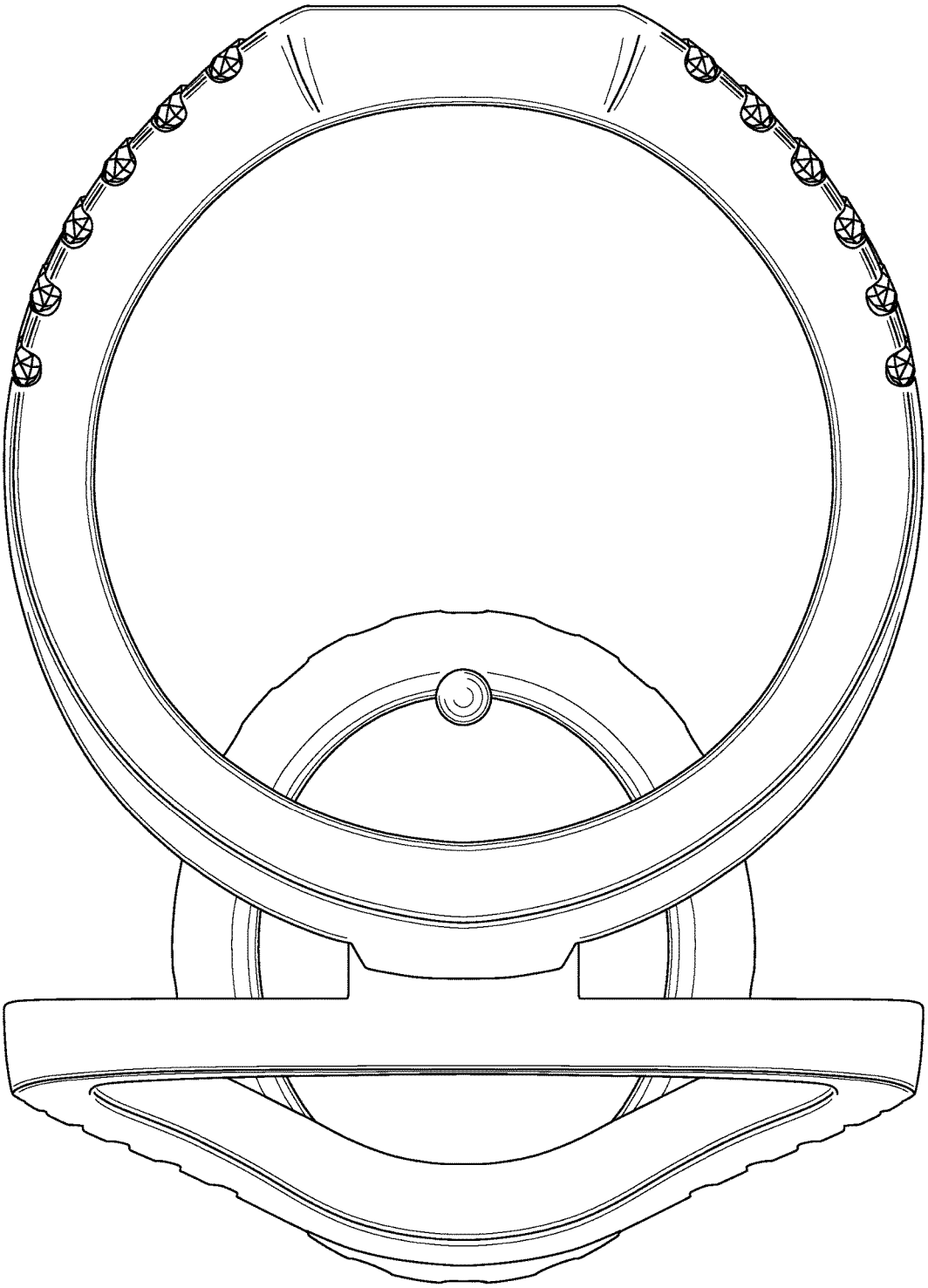
FIG. 15 shows a plan view from below the outer ring, in an embodiment of the disclosed technology.
Figure 16:
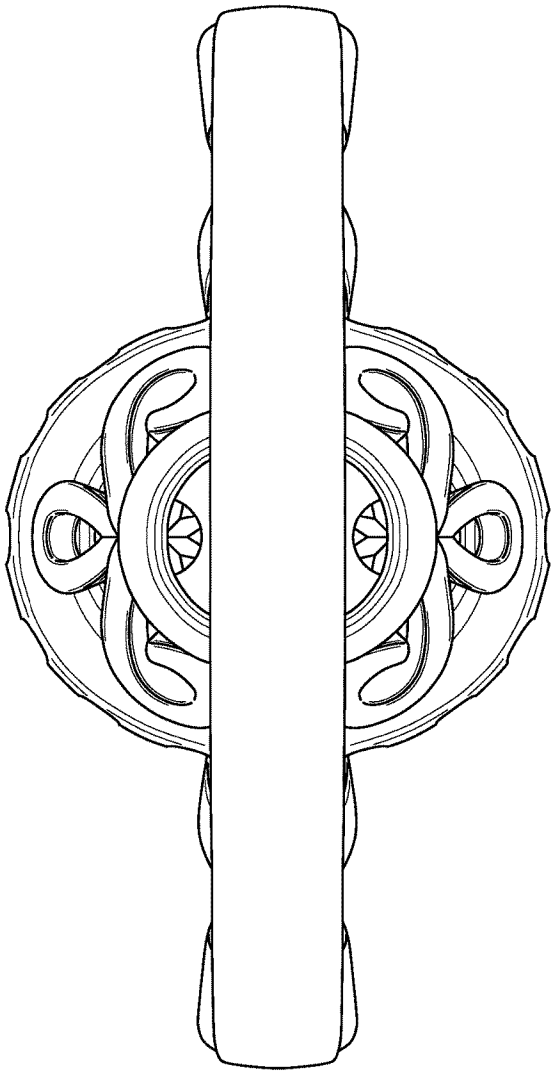
FIG. 16 shows a plan view from below the inner ring, in an embodiment of the disclosed technology.

FIG. 14 shows a top and side elevation view of the inner ring, in an embodiment of the disclosed technology. The inner ring 120 has ornamentation 180 in some embodiments. An inner halo 110 has further gemstones/ornamentation 112 on a top side of the halo 110. The inner halo 110 is filled, in some embodiments, with still further gemstones and/or ornamentation 115, in a setting 118 having side walls which rise above a plane defined bythe inner halo 110 and/or the upper most extremity of the ornamentation 112.

Figure 17:
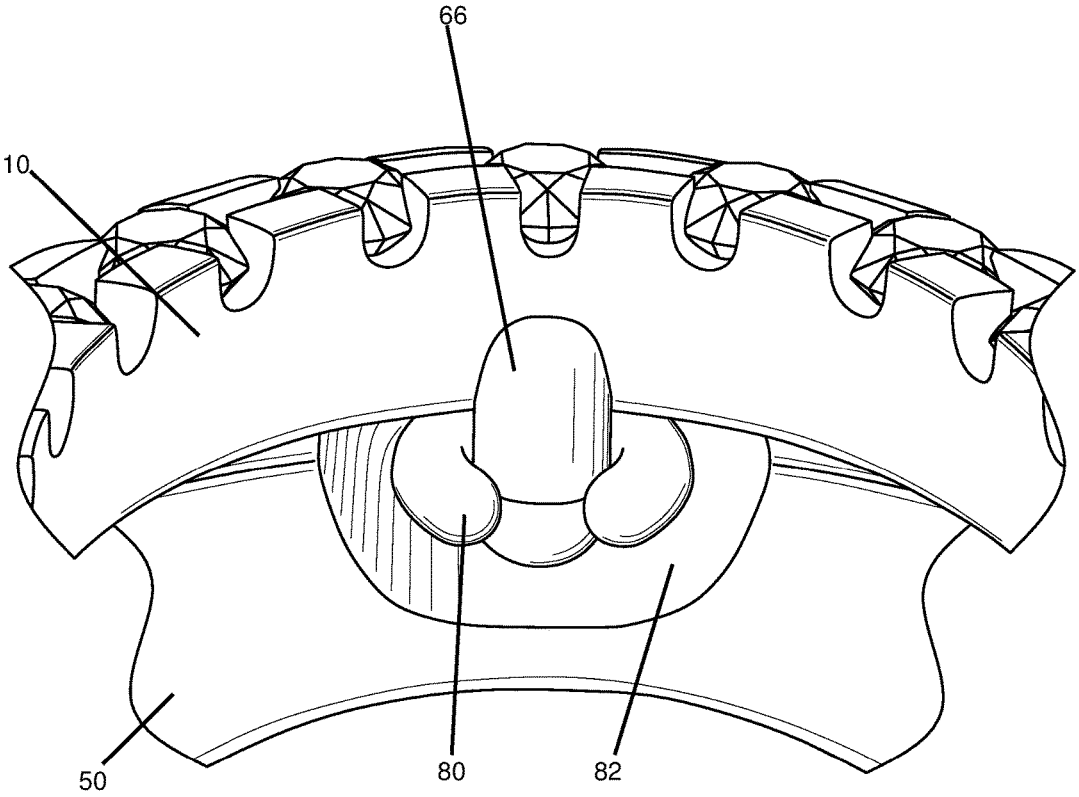
FIG. 17 shows a closeup view of the attachment mechanism which connects an outer ring to an inner ring in embodiments of the disclosed technology.

FIG. 17 shows a closeup view of the attachment mechanism which connects an outer ring to an inner ring in embodiments of the disclosed technology. The two-sided clasp 80 attaches around the spherical projection 86. A cavity 82 is cut into the inner side of the outer ring 50 to accommodate both the clasp 80 and spherical projection 86 such that they can be removably attached to one another while the halo 10 sits flush on top of the ring 50.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

I claim:

1. A halo effect ring, comprising:

a halo formed from at least an inner concentric circle and an outer concentric circle;

a first outer ring and a second outer ring each with substantially identical portals to each other;

a hinge rotatably connecting said first outer ring and said second outer ring to each other;

said outer concentric circle fixedly connected to said first outer ring and removably connected to said second outer ring; and said inner concentric circle fixedly connected to an inner ring and comprising a portal substantially aligned with said identical portals of said first outer ring and said second outer ring.

2. The halo effect ring of claim 1, wherein said inner ring is frictionally held against said hinge.

3. The halo effect ring of claim 2, wherein said inner concentric circle is further from said hinge than said outer concentric circle.

4. The halo effect ring of claim 2, wherein said inner ring is perpendicular to said inner concentric circle.

5. The halo effect ring of claim 4, wherein said inner ring is perpendicular to and aligned with a diameter of said inner concentric circle.

6. The halo effect ring of claim 2, wherein said outer concentric circle comprises a spherical projection aligned perpendicular to said outer concentric circle on a bottom side of said outer concentric ring, said bottom side being opposite a top side, said top side being defined as a side configured to point away from said substantially identical portals.

7. The halo effect ring of claim 6, wherein said second outer ring comprises a two sided clasp gripping said spherical projection;

and said two sided clasp is repeatedly removable and connectable to said spherical projection.

8. The halo effect ring of claim 6, wherein said first outer ring and said second outer ring and are rotatable with respect to one another by way of said hinge and are mirrored on either side of said inner ring when said two sided clasp is gripping said spherical projection.

9. The halo effect ring of claim 2, wherein said inner concentric circle passes through said outer concentric circle before said second outer ring is attached to said outer concentric circle.

10. The halo effect ring of claim 9, wherein said inner ring is wider than a space enclosed by said outer concentric circle requiring that said inner concentric circle, which is fixedly attached to said inner ring, pass through a lower side of said outer ring in order for said inner concentric circle to be concentric to said outer concentric circle when the rings are in the same orientation; and wherein said lower side is a side pointing generally towards said hinge.

11. The halo effect ring of claim 10, wherein said inner ring comprises said inner concentric circle and said inner concentric circle is filled, and said outer concentric circle comprises a portal sized to fit around said inner concentric circle.

12. The halo effect ring of claim 11, wherein said inner concentric circle and said outer concentric circle comprise a circle of identically sized gems.

13. A method of donning said halo effect ring of claim 11, comprising the steps of:

separating said second outer ring from said outer concentric circle;

inserting said inner concentric circle into said outer concentric circle;

resting said inner ring on said hinge;

attaching said second outer ring to said outer concentric circle such that said portal of said first outer ring, second outer ring, and said inner ring are in alignment.

14. A method of donning said halo effect ring of claim 1, comprising the steps of:

separating said second outer ring from said outer concentric circle;

inserting said inner concentric circle into said outer concentric circle;

resting said inner ring on said hinge;

attaching said second outer ring to said outer concentric circle such that said portal of said first outer ring, second outer ring, and said inner ring are in alignment.

15. The halo effect ring of claim 1, wherein said first outer ring and said second outer ring have a rotatable range of motion with respect to one another of up to 90 degrees.

16. The halo effect ring of claim 15, wherein an outer diameter of said inner ring is substantially equal to a shortest distance between said hinge and said outer concentric circle.

17. The halo effect ring of claim 16, wherein three steps are formed at a top side of said halo effect ring:

a first step formed from said outer concentric circle which is both fixedly and removably attached said outer ring;

a second step formed from said inner concentric circle which is fixedly attached to said inner ring;

a third step with gems centered within a plane which extends perpendicularly to an inner region of said inner concentric circle.

* * * * *